US011746552B2

(12) United States Patent
Murrin et al.

(10) Patent No.: US 11,746,552 B2
(45) Date of Patent: Sep. 5, 2023

(54) CAP ASSEMBLY FOR A T-POST RIGHT OF WAY LINE MARKER

(71) Applicant: S & B Technical Products, Inc., Fort Worth, TX (US)

(72) Inventors: Pamela C. Murrin, Fort Worth, TX (US); Charles I. Allen, Houston, TX (US)

(73) Assignee: S & B Technical Products, Inc., Fort Worth, TX (US)

( * ) Notice: Subject to any disclaimer, the term of this patent is extended or adjusted under 35 U.S.C. 154(b) by 0 days.

(21) Appl. No.: 17/903,191

(22) Filed: Sep. 6, 2022

(65) Prior Publication Data

US 2023/0074471 A1 Mar. 9, 2023

Related U.S. Application Data

(60) Provisional application No. 63/261,019, filed on Sep. 9, 2021.

(51) Int. Cl.
*E04H 12/22* (2006.01)
*E04H 17/00* (2006.01)

(52) U.S. Cl.
CPC ..... *E04H 12/2253* (2013.01); *E04H 17/006* (2021.01)

(58) Field of Classification Search
CPC ..... E04H 12/2253; E04H 12/2284; E04H 12/2276; E04H 12/2292; E04H 12/2261; E04H 12/2269; E04H 12/22; E04H 17/006; G09F 15/00
USPC ..... 248/545, 507, 219.2; 116/209, 200, 201, 116/202, 63 R
See application file for complete search history.

(56) References Cited

U.S. PATENT DOCUMENTS 4,623,756 A * 11/1986 Wilson, Jr. ..... H01B 17/145 256/10
5,731,895 A 3/1998 Owczarzak et al.
5,956,875 A 9/1999 Aughenbaugh
6,286,450 B1 * 9/2001 Murrin ..... G09F 15/00 116/63 R
6,321,679 B1 11/2001 Murrin et al.
6,421,881 B1 * 7/2002 Shovlin ..... F16H 59/02 74/553
6,543,750 B1 * 4/2003 Calzone ..... E04H 17/006 256/19
6,691,479 B1 * 2/2004 Tscharner ..... A01G 17/14 74/543
7,028,991 B2 * 4/2006 Egan ..... E04H 17/006 256/65.01
7,500,653 B1 * 3/2009 Hartman ..... E04H 17/24 256/22

(Continued)

*Primary Examiner* — Nkeisha Smith
(74) *Attorney, Agent, or Firm* — WHITAKER CHALK SWINDLE & SCHWARTZ PLLC; Charles D. Gunter, Jr.

(57) ABSTRACT

A cap assembly is shown for a right of way line marker which includes a cap body with a conical exterior and an end opening. A mounting assembly including a lower, stationary disk and an upper, sliding disk are received within the end opening of the cap body. The lower disk has a T-shaped aperture therein for receiving an upper exposed end of a T-shaped vertical support member. The upper sliding disk is positionable within the cap open interior upon contact with the upper end of the support member to thereby securely mount the cap assembly about the right of way line marker.

11 Claims, 10 Drawing Sheets

(56) References Cited

U.S. PATENT DOCUMENTS

| | | | | |
|---|---|---|---|---|
| 8,113,473 | B2 | 2/2012 | Bradley | |
| 8,646,735 | B2 * | 2/2014 | Bradley | E04H 17/20 256/65.02 |
| 9,309,673 | B1 * | 4/2016 | Tscharner | E04C 5/161 |
| 9,809,992 | B1 | 11/2017 | Barlow | |

* cited by examiner

CAP ASSEMBLY FOR A T-POST RIGHT OF WAY LINE MARKER

CROSS REFERENCE TO RELATED APPLICATIONS

The present application claims priority from an earlier filed provisional application, Ser. No. 63/261,019, filed 9 Sep. 2021, with the same title and by the same inventors.

BACKGROUND OF THE INVENTION

Field of the Invention

The present invention relates generally to T-post style line markers and, more specifically, to line marker T-posts having indicia caps for marking the location of buried conduit such as a pipeline or utility conduit.

Description of the Prior Art

A variety of pipeline or utility line marking systems are in use at the present time. The purpose of these pipeline or utility marking systems is to indicate the location of buried pipeline, cable, conduit, etc., (referred to collectively as conduit herein), as well as to identify its owner. By properly marking the subterranean conduit, construction crews and others attempting to excavate the site can avoid accidentally damaging the buried conduit. The marker also serves as a warning to the general public that a buried conduit is present in the area.

It is common practice for such line markers to employ upright posts made of steel. The steel post may be called a U-post, a T-post, a Y-post, or variants, depending upon the design and country of origin. They may be made of, for example, durable rail steel. These posts are also commonly used to support various types of wire or wire mesh, or signs such as road signs. The end view or cross section of the post creates an obvious T, Y, U or other shape. The posts are driven into the ground with a manual or pneumatic post pounder. All along the post, along the spine, there are studs or nubs that prevent the barbed wire or mesh from sliding up or down the post. They are commonly designated as 1.01, 1.25 or 1.33 posts, referring to the weight in pounds per lineal foot. They are commonly painted with a colored tip on top in order to improve the visibility of the fence line.

A number of years ago, Applicant introduced a right of way line marker, sold as the "Maloney Line MRKR™" system, which has enjoyed considerable commercial success. The original Maloney Line MRKR™ system included an upright support member which had a cylindrical exterior with a lower end which is positionable within a surrounding terrain so that the upright member is positioned in an upright vertical position. The cylindrical upright member carries an end cap on the upper exposed extent thereof. The end cap and upright support member are preferably formed of a synthetic plastic such as high density polyethylene. Either the end cap or an associated sleeve carries indicative marking such as "GAS PIPELINE", "WARNING PETROLEUM PIPELINE", or "FIBER OPTIC CABLE." The marker post is available in vivid colors that stand out against any background. A typical marker is provided in, for example, 3.75 inch OD tubular design, and is highly visible from any angle as well as from the air. The addition of a fluorescent cap enhances visibility for aerial observation.

The tubular nature of the "Maloney Line MRKR™" offers several advantages over the traditional "flat" right of way line marker posts. For example, the polymeric tubular marker cannot spark when struck, thereby eliminating the possibility of spark ignition, fire or explosion and is less susceptible to "wind whip" that can occur with flat line markers. The greatest advantage of the tubular design is perhaps the ease of visibility from any angle, as well as from the air.

In spite of the advantages of the synthetic, tubular line marker, a large number of line markers exist is use today which utilize upright steel posts, of the type previously described, which are "U-channel" members in cross sectional view. Applicant has previously provided a line marker system for the C-channel or U-post style steel posts which featured its synthetic plastic end cap. The Maloney QuickSnap™ Linemarker Heads provided a new, unique and cost-effective way for underground utility owners and operators to convert out-of-date "flat" signs incorporating C-channel or U-post supports, or for new installations where metal posts are used. This simple and effective marker conversion is easily accomplished in the field with ordinary hand tools.

The QuickSnap™ system was specifically designed for steel posts with either the U-post or C-post configuration. A cap assembly includes a cap body with a conical exterior and an end opening. A mounting assembly including a lower, stationary disk and an upper, sliding disk are received within the end opening of the cap body. The lower disk has an aperture therein for receiving the upper end of a vertical support member which, in this case, had a U-shaped cross section. The upper sliding disk is positionable within the cap open interior upon contact with the upper end of the support member to thereby securely mount the cap assembly about the right of way line marker.

The lower disk also included a particular type of "locking detent" for engaging vertically spaced circular openings present on the U-post. The locking detent is formed as a flexible member which terminated in a circular projection which is engageable with the mating openings present in the upright steel post. The main body of the detent is appropriately shaped so that it can ride over contact surfaces of the upright support during assembly. Since the U-shaped and C-shaped steel posts had a series of round holes running up and down the length thereof, the projecting portion of the locking detent was also a circular shaped member. Once received in one of the holes on the upright, reverse direction of travel of the cap was prevented.

While the QuickSnap™ system worked perfectly well with steel posts of the U-channel and C-channel variety, it would also be advantageous to provide such a marker cap system designed specifically for the T-post style steel posts. T-post style fence posts are in wide use today for a variety of purposes and are commonly available from a number of commercial sources. However, since the T-post lacks the series of vertically placed openings present in the U-channel and C-channel posts, the previously design detent mechanism was not compatible.

SUMMARY OF THE INVENTION

It is therefore an object of the present invention to design a marker cap of the previously described type which would allow a T-post type upright support member to be equipped or retrofitted with a high visibility tubular cap.

Another object of the invention is to provide such a cap assembly for a traditional steel T-post which allows a conical end cap to be quickly and exactly installed on the exposed upper end of the steel post.

Another object of the invention is to provide a cap assembly which includes a unique mounting assembly for quickly and securely mounting the conical end cap upon the upright T-post style marker post.

Another object of the invention is to provide such a cap assembly which is simple in design and economical to manufacture.

These and additional objects of the invention are met by a new cap assembly for a right of way line marker which is specifically designed to work with a "T-post" upright support member having an exposed upper end, a lower end, and a T-shaped cross section. The lower end is positionable within a surrounding terrain in use to position the support member in an upright vertical position. The assembly includes a cap body having a conical exterior with an end opening and an initially open interior. The cap also includes a mounting assembly comprising a lower, stationary disk which is sized to be received and retained within the end opening of the cap body and an upper, sliding disk. The lower, stationary disk has a T-shaped aperture therein for receiving the T-shaped upper end of the support member. The upper, sliding disk is positionable within the cap open interior upon contact with the upper end of the support member to provide stability for the cap assembly.

Preferably, the upper and lower disks each have upper and lower planar surfaces, respectively, the planar surfaces being arranged in a plane generally perpendicular to the vertical axis of the support member in use. A locking detent is located on the upper planar surface of the lower disk. The locking detent cooperates with engagement surfaces provided on the upright support member for locking the lower disk and, in turn, the cap at a plurality of selected vertical locations on the support member. The lower disk can be formed of a resilient synthetic material whereby the locking detent can be provided as a flexible flap which is integrally formed with the upper planar surface of the lower disk.

The commonly available T-post support member has a series of vertically spaced "nubs" which run up and down the length thereof generally along the vertical axis of the post. The locking detent preferably assumes the form of a flexible flap which is movable between a relaxed position when in between a selected pair of raised nubs, and a flexed position when riding over a selected nub on the support member for locking the lower disk and, in turn, the cap at a plurality of selected vertical locations on the support member.

In one preferred form, the upper and lower disks are also provided with mating engagement members which are located their exposed, planar surfaces. In this way, the disk components can initially be assembled with the respective planar faces thereof engaged and in contact, thereby forming a compact unit for shipping or for immediate installation.

The unit can be easily installed within the end opening of the conical cap with the upper and lower disks located at the approximate end opening of the cap. As the T-shaped support member is inserted through the aperture provided in the lower disk, it contacts the upper disk and slides the disk vertically upward within the opening interior of the cap body to a selected location therein. The presence of the lower disk with its support member receiving aperture and the upper disk provides a stable arrangement for mounting the cap assembly upon the upright support member.

Additional features and advantages will be apparent in the written description which follows.

DETAILED DESCRIPTION OF THE INVENTION

The preferred version of the invention presented in the following written description and the various features and advantageous details thereof are explained more fully with reference to the non-limiting examples included and as detailed in the description which follows. Descriptions of well-known components and processes and manufacturing techniques are omitted so as to not unnecessarily obscure the principal features of the invention as described herein. The examples used in the description which follows are intended merely to facilitate an understanding of ways in which the invention may be practiced and to further enable those skilled in the art to practice the invention. Accordingly, the examples should not be construed as limiting the scope of the claimed invention.

Figure 1:
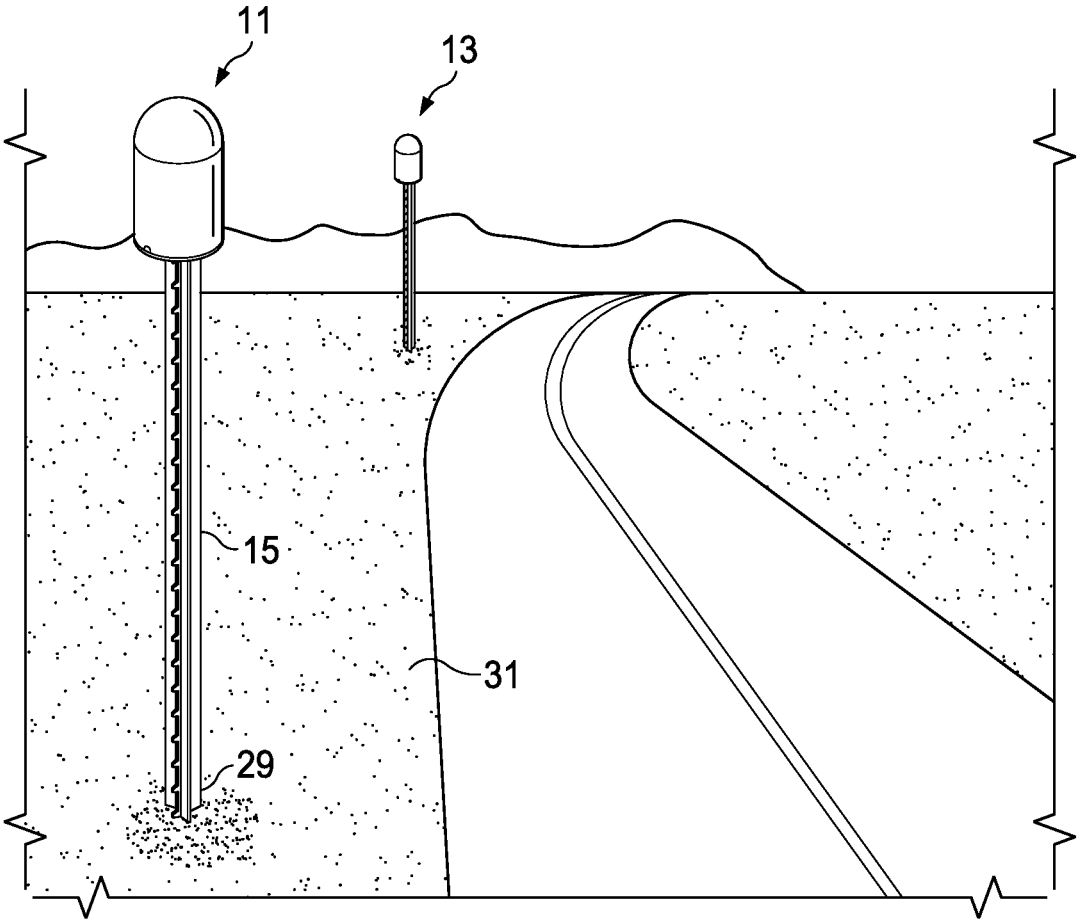
FIG. 1 is a perspective view of an earthen terrain showing the cap assembly of the invention on a T-post style line marker located beside a highway right of way.

The discussion which follows will focus primarily FIG. 1 shows a pair of marker posts used in the system of the present invention, designated generally as 11, 13. The marker posts are typically used for marking the location of buried conduit of various types including natural gas pipelines, petroleum pipelines, fiber optic, utility and telecommunication cable, etc. The line marker posts utilize an upright support member (15 in FIG. 1) which, in this case, is formed of steel.

Figure 2:
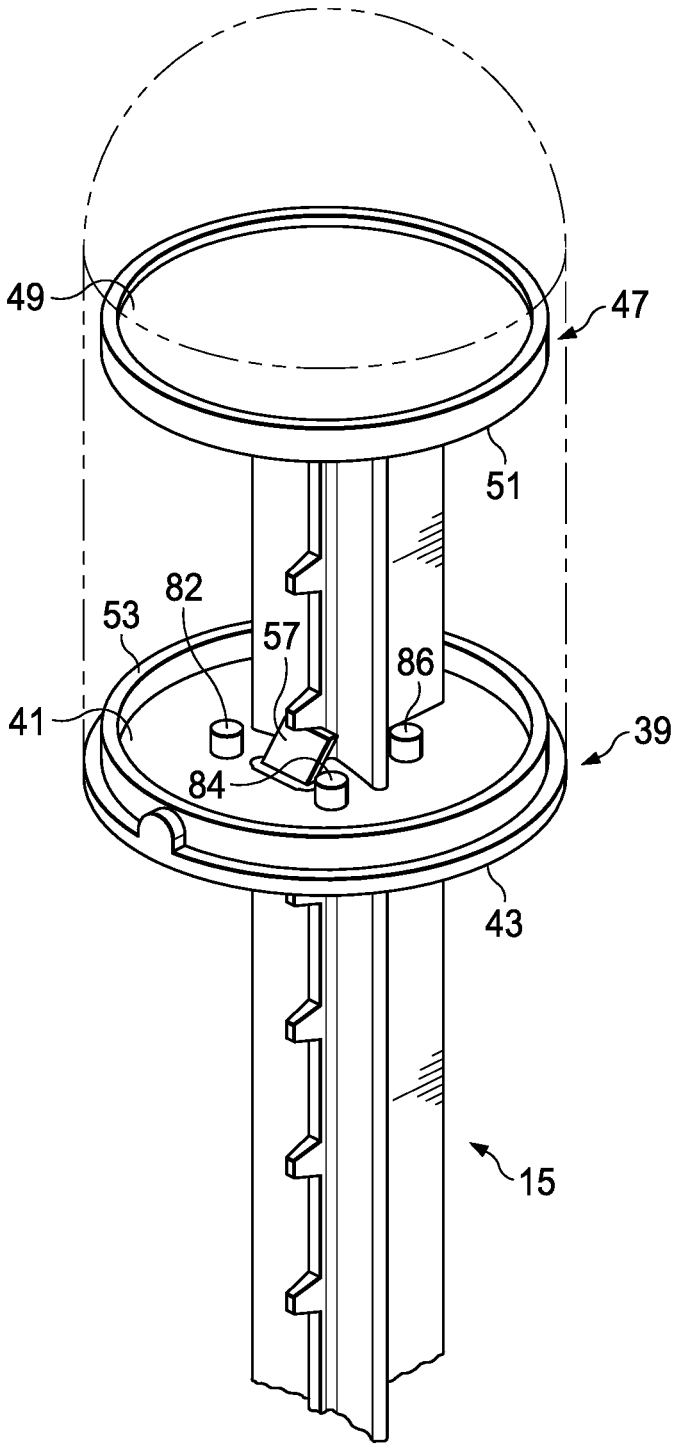
FIG. 2 is an isolated view of the assembled cap assembly on the upper end of the T-post support member with the marker cap body illustrated in phantom lines.
Figure 3:
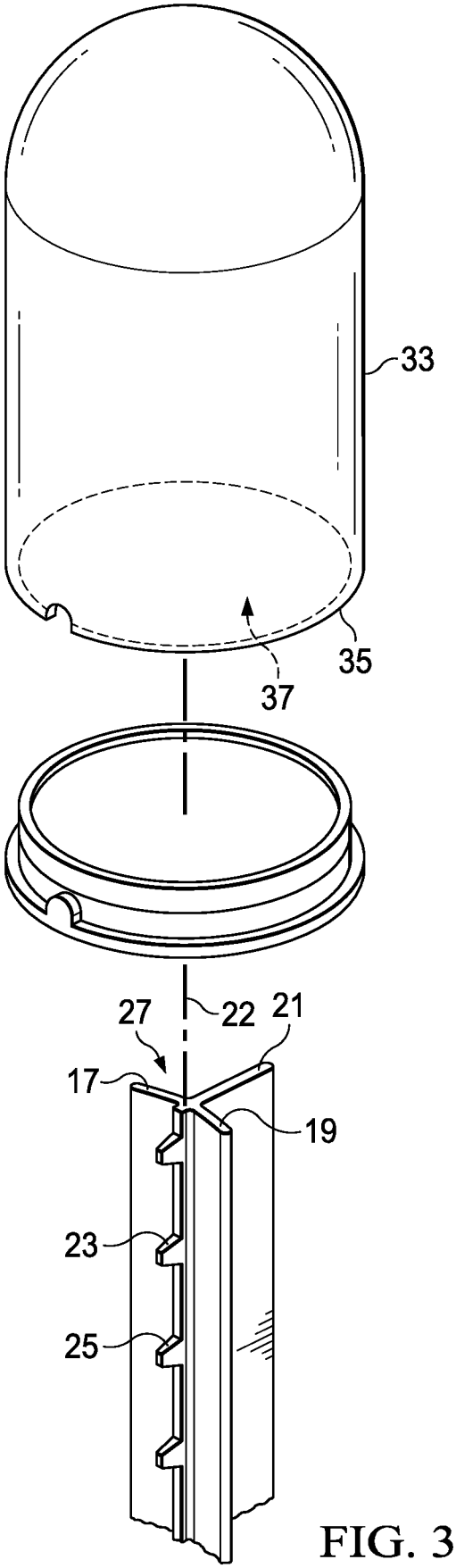
FIG. 3 is an exploded view of the cap assembly with respect to the upper end of the T-post support member.

As perhaps best seen in FIGS. 2 and 3, the upright support member 15 has a generally T-shaped cross-section defined by the opposing outer flanges 17, 19, 21 (FIG. 3). The upright support member has a length defined along a vertical axis 22 and has a plurality of outwardly extending nubs, such as nubs 23, 25, shown in FIG. 3. The nubs are generally evenly spaced and run up and down the T-post vertical axis 22. A common use for the nubs is as an attachment point for stringing wire for a wire fence. As has been mentioned, metal fence posts of this type are commonly described by weight, e.g., 1.33 lbs/ft and 1.25 lbs/ft for two commonly used posts. They are widely available from a variety of commercial sources.

The cap assembly of the invention is intended for use with such an upright T-post support member, such as member 15, which has an exposed upper end 27 (FIG. 3) and a lower end 29 (FIG. 1) which is positionable within a surrounding terrain 31 in use to position the upright support member 15 in an upright vertical position.

The cap assembly includes a cap body 33 (FIG. 3) having a generally conical exterior with an end opening 35 and an initially open interior 37. The cap body 33 is typically formed from a suitable synthetic plastic, synthetic elastomer or polyolefin material. A mounting assembly is used to securely affix the cap body 33 to the upright support member 15. The mounting assembly includes a lower, stationary disk 39 (FIG. 2) which is sized to be received and retained within the end opening 35 of the cap body 33 (FIG. 3). The lower, stationary disk has a top and bottom planar surfaces 41, 43, respectively, and has an aperture 45 (FIG. 4) formed therein which is shaped to receive the upper end 27 (FIG. 3) of the upright support member 15. In the embodiment illustrated in FIGS. 2 and 4, the aperture 45 has a generally T-shaped outline. As will be explained more fully, the face of the aperture 45, as seen from the bottom view in FIG. 4, has inwardly tapered sidewalls 46 to help guide the upper end 27 of the steel upright into the aperture.

The mounting assembly also includes an upper, sliding disk 47 which, as shown in FIG. 2, is positionable within the cap open interior 37. The upper disk 47 is positionable at a various axially displaced locations upon contact with the upper end 27 of the support member 15. The upper sliding disk 47 also has top and bottom planar surfaces 49, 51, respectively. The bottom planar surface 51 (FIG. 5) has three alignment or locating knobs 82, 84, 86 which straddle the upright member upper end 27 during assembly. Preferably, the upper and lower disks are formed of a resilient synthetic plastic or synthetic elastomer. One preferred synthetic material is high density polyethylene (HDPE). The lower disk 39 is formed with an outer lip 53 which engages the lower extent 55 (FIG. 12) of the cap body 33.

Figure 9:
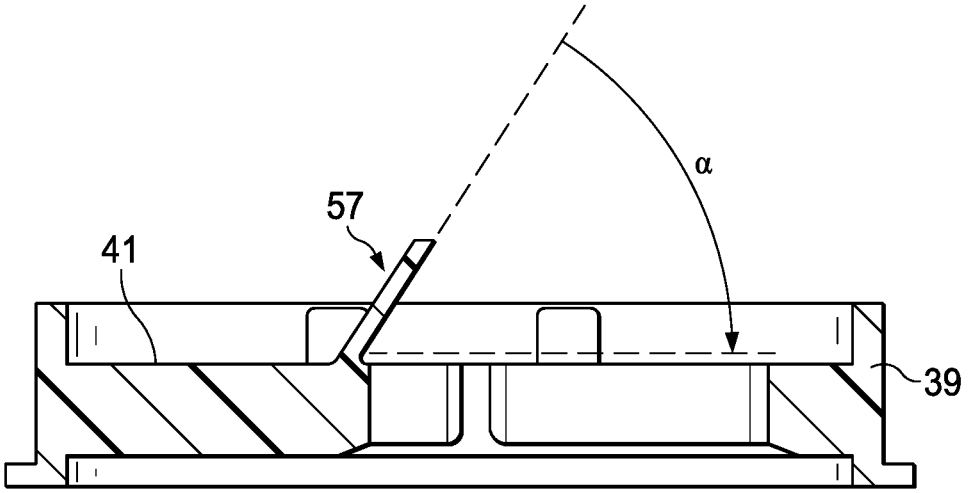
FIG. 9 is a side, cross-sectional view taken along lines 9-9 in FIG. 8.
Figure 10:
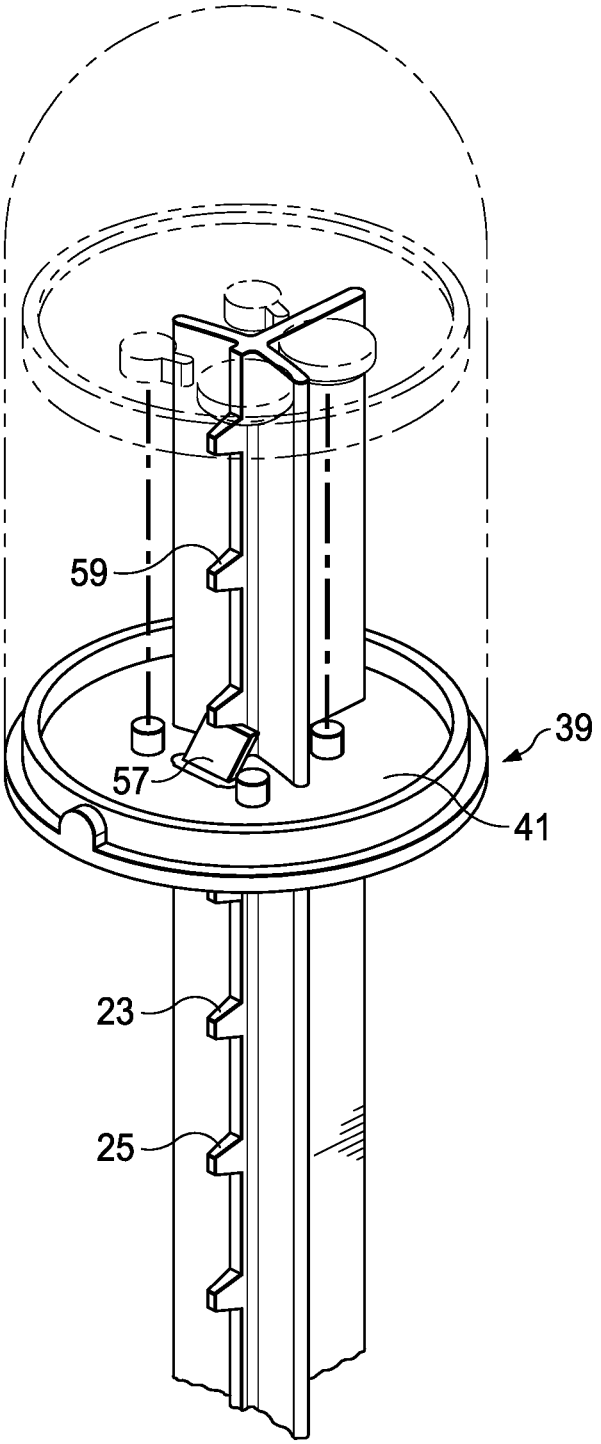
FIG. 10 is a close-up view of the installed cap assembly of the invention on a T-shaped support post with the external cap body and certain of the internal components illustrated in phantom lines.
Figure 11:
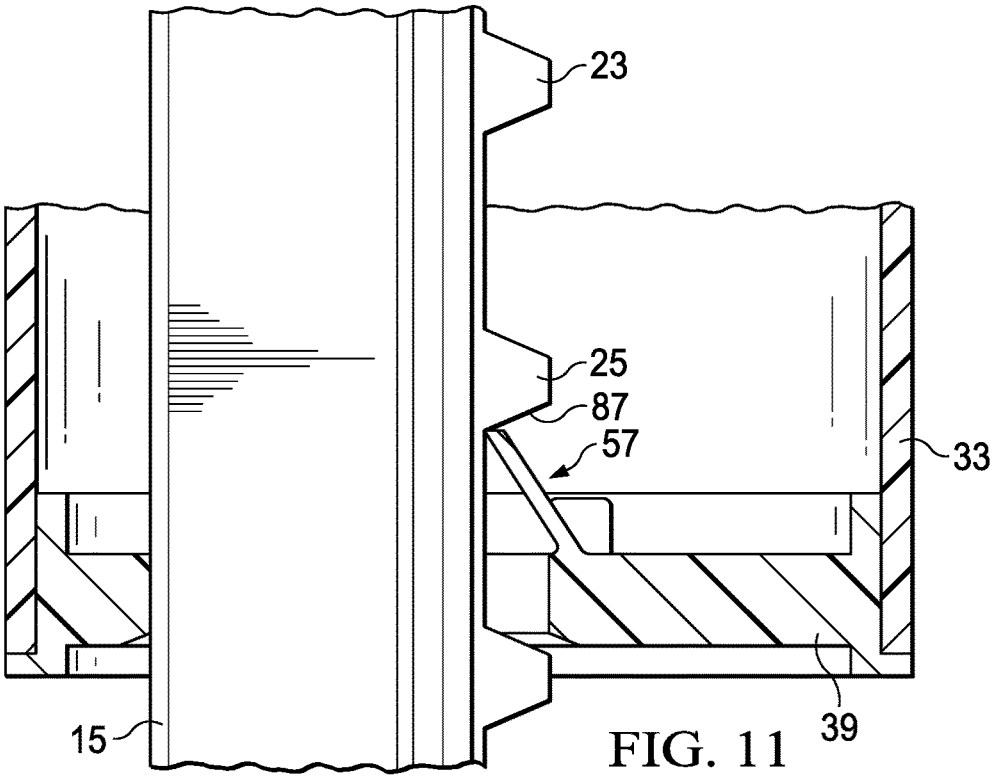
FIGS. 11 and 12 are schematic illustrations of the installation of the cap assembly of the invention showing the movement of the flexible detent carried on the lower disk thereof.
Figure 12:
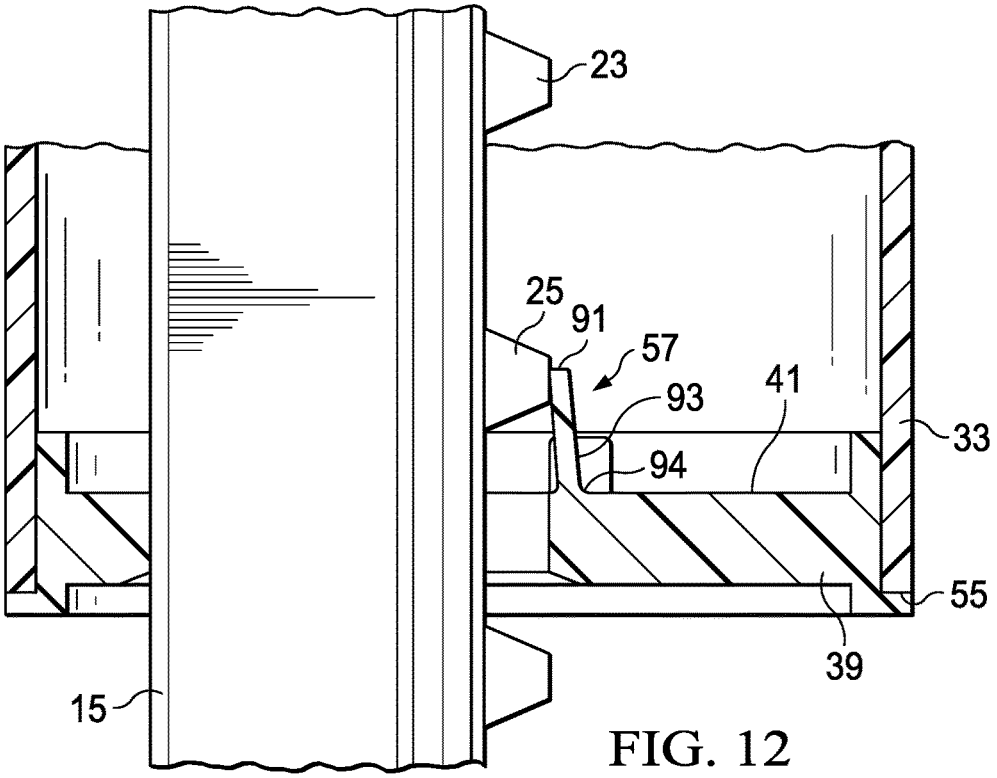

As shown in FIGS. 9 and 10, the locking detent 57 includes a flexible hinge-like body or flap 57 which extends from the upper surface 41 of the lower disk 39. The flexible flap is formed integrally with the upper planar surface 41 of the lower disk 39. The flexible flap has a generally planar body when viewed in cross section (FIG. 9) and an outermost edge (91 in FIG. 12) connected by opposing sidewalls (93 in FIG. 12) to a base region 94 located in the top planar surface 41 of the bottom disk 39. As best seen in FIGS. 10-12, the flexible flap 57 rides along the upper tapered surfaces (59 in FIG. 10) of the post nubs, in an unlocked position, as the cap is being installed on the post, but snaps into the locked position shown in FIG. 10 to prevent reverse direction of travel. The assembly could be removed, once installed, by inserting a suitable tool (not shown) within the aperture formed in the lower disk to push the flexible flap 57 upwardly and temporarily out of the way of the post nubs 23, 25, thereby allowing the cap assembly to be pulled from the upper end of the support member 15.

Figure 5:
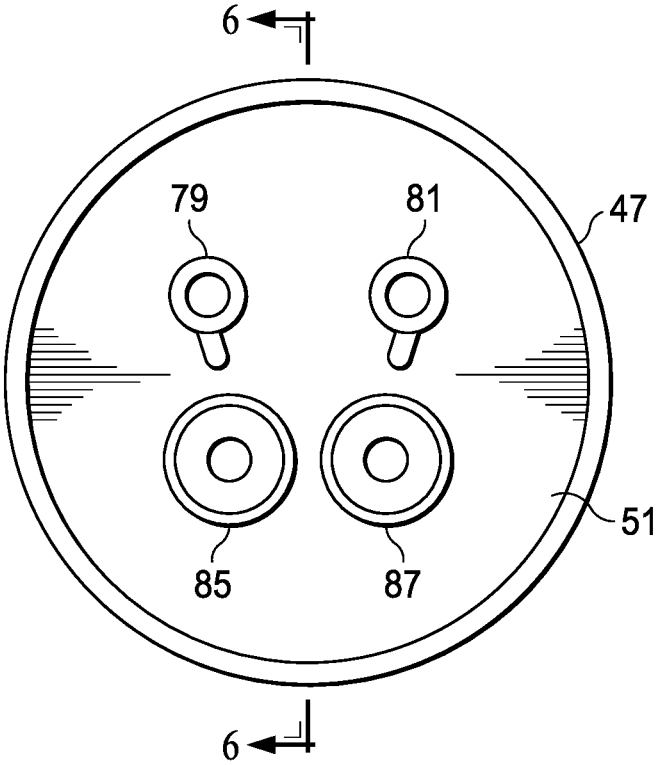
FIG. 5 is a view of the bottom planar surface of the upper disk of the cap assembly of the invention.

In order to facilitate storage and shipping, the lower and upper disks 39, 47, are preferably provided with mating engagement members located thereon. In this way, the disks can be initially assembled with the respective planar faces of the disks in contact and with both disks located at the approximate end opening of the cap. As has been briefly described, and as shown in FIG. 10, the mating engagement members can comprise knobs 82, 84, 86, which extend upwardly from the top planar surface 41 of the lower disk 39 and which are received within mating bores, for example, bores 79, 81, 85, 87, provided in the bottom planar surface 51 of the upper disks 47 (FIG. 5).

In the method of the invention, the cap body and mounting assembly are typically provided as an assembled unit with the lower and upper disks 39, 47 in the position shown in FIG. 3 and with the disk mounting assembly located within the end opening 35 of the cap body 33. The upper end 27 of the upright support member 15 is then inserted through the aperture 45 in the lower disk 39. As the upper end 27 of the support member is moved through the cap interior 37, it contacts the upper disk and drives the upper disk to an axially displaced location (FIG. 2) within the cap interior 37. The upper and lower disks thus serve to securely mount the cap body 33 about the upper end 27 of the support member 15.

With reference to FIGS. 11 and 12, it will be appreciated that, as the upper end of the support member 15 moves within the cap interior 37, the flexible flap 57 is forced from an initially relaxed position (FIG. 11) to the extended position shown in FIG. 12. When the upper disk 47 has wedged within the cap interior 37, the flexible flap returns to the relaxed position shown in FIG. 11 with the outermost edge 91 of the flap lodged beneath the lower surface 87 of the post nub. In this position, the flap 57 prevents the cap from being pulled off the upright support member in the opposite direction. The detent mechanism can thus be used to lock the lower disk 39 and, in turn, the cap 33 at a plurality of selected vertical locations on the support member 15.

Figure 13:
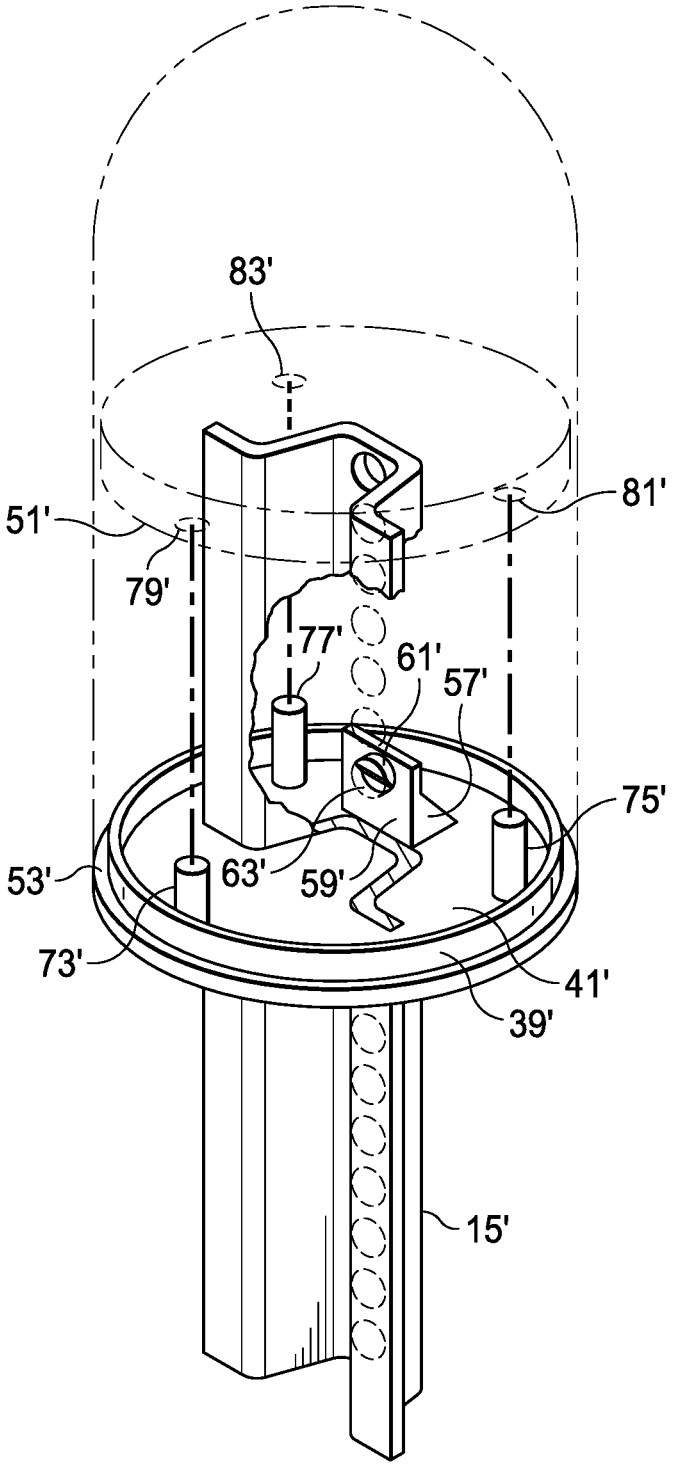
FIG. 13 (PRIOR ART)
FIG. 13 is a view similar to FIG. 10, but showing the prior art line marker cap assembly.
Figure 14:
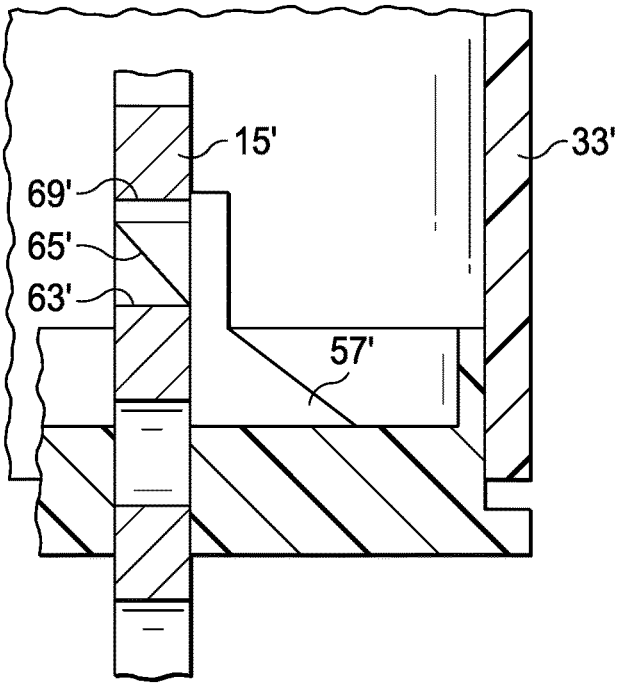
FIG. 14 (PRIOR ART)
FIGS. 14 and 15 are views similar to views 11 and 12, but showing the assembly of the prior art line marker cap on the U-channel steel upright post in order to illustrate the differences in the present invention.
Figure 15:
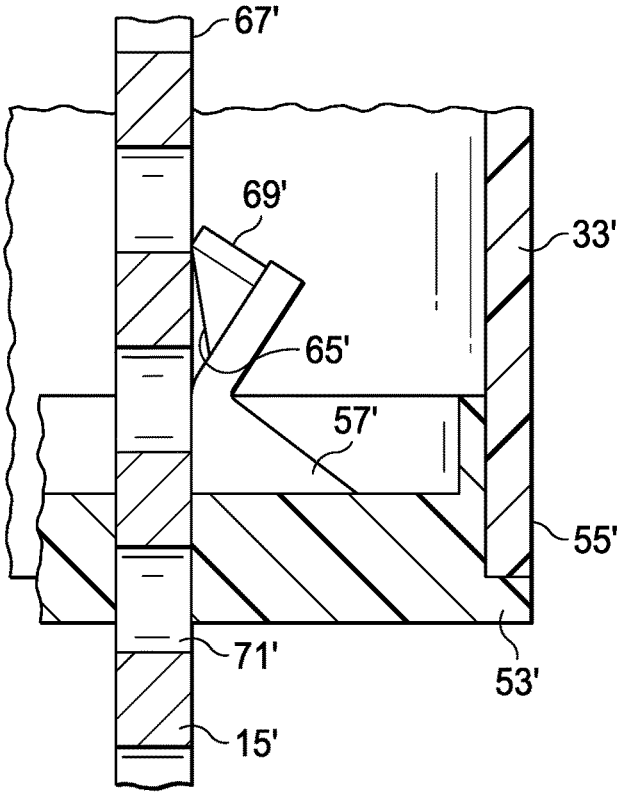
FIG. 15 (PRIOR ART)

FIGS. 13-15 illustrate the prior art cap assembly in order to further explain the important differences in the new design. The various components shown in FIGS. 13-15 are given the same numbers as the equivalent components previously described, except with a prime added. Note the circular detent which fits in the circular opening 63 in the U-channel post.

There were a number of problems that were encountered in redesigning the marker cap of the invention from the previous design which was designed specifically for the U-shaped post. The holes in the former U-channel posts tended to be more or less uniform in size, whereas the "nubs" formed on the T-shaped posts did not tend to be uniform. It was also necessary to determine the proper "attack angle" which the flexible flap 57 formed with the top surface 41 of the lower disk 39. The flap cannot be too long or too short and must be at the right attack angle to allow it to pass over the post nubs during the assembly operation. Thus, the thickness, length and angle of the flap are important design considerations. While making the flap thicker, for example, might increase its strength, it might also tend to make the flap take a permanent set when flexed, which would not be desirable. In the preferred form of the invention, there is no permanent set characteristic or hysteresis loss in the flexible flap (i.e., it is not slow to react or retarded in response to forces acting thereon).

Some of the problems encountered in the design phase were:

1. Damage to the locking flap;
2. Failure of the locking flap to return to the original position after deflection sufficiently to retain the head on the post;
3. Secure retention of the head to the T-post due to the geometry of the nubs on the ost (this is uch less certain retention than the previous design in which a circular detent engaged holes in the U-channel post;

4. Rigidity of the flap was too great, making the installation of the post difficult or impossible by hand, which is a requirement since the line marker head will generally need to be installed in the field, on posts already in the ground.

One important advantage of the present design is the ability to use the same part efficiently for both the 1.25 lbs/ft post and the 1.33 lbs/ft post. As such, design features were incorporated which allowed a uniform footprint of the flexible flap. A preferred design for the flap turned out to be a flap which is approximately 1 mm thick×12 mm wide at the engagement point or apex (shown as 91 in FIG. 12). These flap dimensions are combined with an attack angle (shown as "α" in FIG. 9) which is generally less than about 65 degrees, preferably about 30 to 64 degrees, for example, about 60 degrees or less. These dimensions and angle have been found to allow minimal insertion force while retaining enough "spring" to ensure engagement as a lock. Again, the amount of displacement of the locking flap is a compromise between locking force, position recovery after displacement, material durability and installation force required during assembly.

The preferred flap is both flexible and strong enough to perform as expected, while minimizing the force required to assemble marker cap on the post. Both the length and the angle of the flap had to be adjusted in the course of prototyping to enhance ease of assembly, secure retention and the durability of the part. The HDPE material provided stability and durability to weathering.

As will be appreciated from FIGS. 2 and 5, the upper plate 47 in the new design performs the same function as the previous upper plate, but the engagement features (82, 84, 86 in FIG.) had to be changed to prevent movement left to right as well as front to back because of the highly symmetrical shape of the T-post. Note the placement of the engagement openings 79, 81, 85, 87 in FIG. 5 as compared to the location of the engagement posts 73, 75, 77, for the old design. The new engagement elements are located on a much smaller radius from the center of the disk 47.

Figure 4:
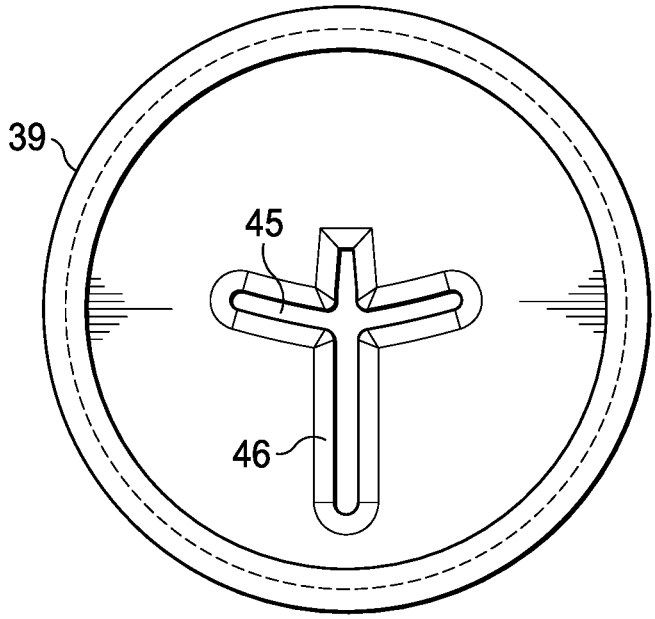
FIG. 4 is a view of the bottom planar surface of the lower disk of the cap assembly of the invention.
Figure 8:
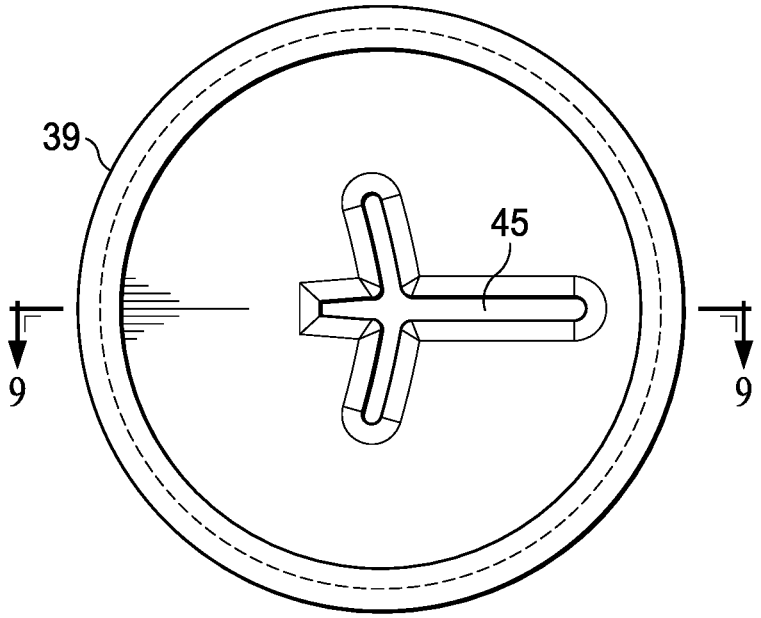
FIG. 8 is a view of the top planar surface of the lower disk of the cap assembly.

As also briefly mentioned, with reference to FIGS. 4 and 8, it was also necessary to provide a tapered aperture (45 in FIG. 4) in the lower disk to accommodate the different shape in the T-post. In other words, the sidewalls of the aperture 45 are not vertical, but rather slant at an angle to facilitate alignment with the head (27 in FIG. 3) of the T-post. Note the tapered, slanted sidewalls 46 in the bottom view of FIG. 4 as compared to the nearly vertical openings in the top surface shown in FIG. 8. This type metal post is now somewhat standardized by the various manufacturers and is ultimately made to various finished dimensions and tolerances. By designing a tapered engagement surface (45 in FIG. 4) with minimal straight walls on the lower disk, the broadest fit range of acceptance is possible.

Figure 6:
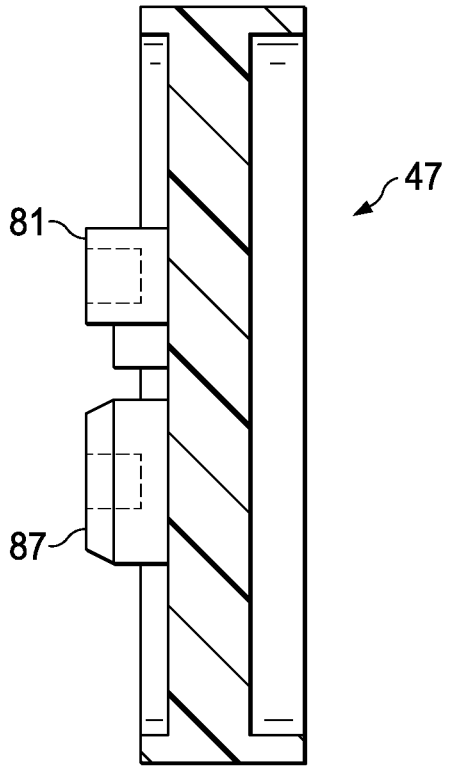
FIG. 6 is a side, cross-sectional view of the upper disk taken along lines 6-6 in FIG. 5.
Figure 7:
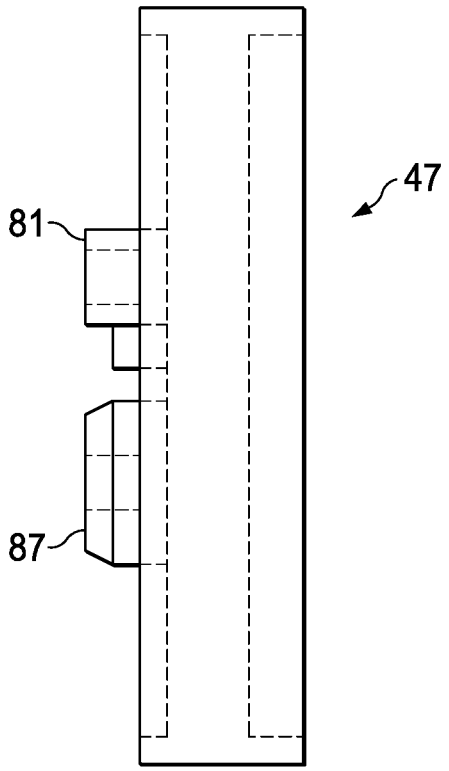
FIG. 7 is another side view of the upper disk, similar to FIG. 6, but not shown in section, the interior profile being indicated by phantom lines.

FIGS. 6 and 7 are alternate side views of the upper disk 47. FIG. 6 is a cross-sectional view, while FIG. 7 is non-sectioned. The internal profile of the disk, shown in these figures allows molding without distortion, reduces the weight of the part and maintains the length of the outside surface to ensure stability after assembly.

An invention has been provided with several advantages. The cap assembly of the invention allows a traditional T-post upright support to be equipped or retrofitted with a conical cap assembly that can serve as a right of way line marker. The conical cap assembly permits better visibility of the marking indicia since it provides a three dimensional profile to the viewer. The cap can be provided of a synthetic material which can assume a variety of shapes and colors. By providing the cap of an ultraviolet stabilized high density polyethylene (HDPE), the components will not fade, warp, absorb water or otherwise deteriorate from prolonged exposure to the elements. By providing a cap of a fluorescent color, the line marker is highly visible from any angle as well as from the air. It does not "whip" in the wind like a polygonal metal sign and thus doesn't tend to break in the wind. The new cap assembly fits the most commonly available metal fence posts without the need for special tools or outside fasteners. It resists theft by securely locking the cap to the metal post. However, the cap can be removed with a simple hand tool, if necessary.

While the invention has been shown in only one of its forms, it is not thus limited but is susceptible to various changes and modifications without departing from the spirit thereof.

What is claimed is:

1. In combination, a cap assembly for a right of way line marker and an upright support member having an exposed upper end, a lower end and an intermediate length running along a vertical axis, the lower end being positionable within a surrounding terrain in use to position the support member in an upright vertical position, the exposed upper end having a T-shape in cross section, at least along a portion of the length thereof, the assembly comprising:

a cap body having a conical exterior with an end opening and an initially open interior;

a mounting assembly including a lower, stationary disk sized to be received and retained within the end opening of the cap body, the lower, stationary disk having a top planar surface and having a T-shaped aperture therein for receiving the upper end of the support member, the mounting assembly also including an upper, sliding disk which is positionable within the cap open interior upon contact with the upper end of the support member and wherein each of the upper and lower disks have a top and bottom planar surfaces, respectively, the planar surfaces capable of being arranged in a plane generally perpendicular to the vertical axis of the support member when the support member is positioned in the surrounding terrain; and wherein the upright support member has a series of raised nubs running in a line along the vertical axis thereof, wherein a locking detent is located on the top planar surface of the lower disk, the locking detent being a flexible flap which is movable between a relaxed position when in between a selected pair of raised nubs during installation, and a flexed position when riding over a selected tab on the support member for locking the lower disk and, in turn, the cap at a plurality of selected vertical locations on the support member after installation is complete.

2. The combination of claim 1, wherein the upper and lower disks have mating engagement members located thereon, whereby the disks can be initially assembled with the respective planar faces of the disks in contact and with both disks located at the end opening of the cap.

3. The combination of claim 1, wherein the flexible flap has a generally planar body when viewed in cross section having an outermost edge connected by opposing sidewalls to a base region located in the top planar surface of the lower disk, the flexible flap body forming an angle with respect to the top planar surface which is less than about sixty five degrees.

4. The combination of claim 3, wherein the angle is in the range from about fifty to sixty four degrees.

5. The combination of claim 4, wherein the angle is approximately sixty degrees.

6. The combination of claim 1, wherein the T-shaped aperture in the lower disk has inwardly tapered sidewalls, as viewed from below, to facilitate entry of the upper end of the upright support member.

7. A method of installing a cap assembly on a right of way line marker which includes an upright T-shaped support member having an exposed upper end and a lower end, the lower end being positionable within a surrounding terrain in use to position the upright T-shaped support member in an upright vertical position, the installation method comprising the steps of:

providing a cap body having a conical exterior with an end opening and an initially open interior;

installing a mounting assembly within the end opening of the cap body, the mounting assembly including a lower, stationary disk sized to be received and retained within the end opening of the cap body, the lower, stationary disk having a top planar surface and having an aperture therein for receiving the upper end of the upright T-shaped support member, the mounting assembly also including an upper, sliding disk having a bottom planar surface, the upper sliding disk being positionable within the cap open interior upon contact with the upper end of the upright T-shaped support member;

inserting the upper end of the upright T-shaped support member through the aperture provided in lower disk, whereby the upper end of the upright T-shaped support member contacts the upper disk and drives the upper disk to an axially displaced location within the cap interior, the upper and lower disks serving to securely mount the cap body about the upper end of the upright T-shaped support member; and wherein the upright T-shaped support member has a series of raised nubs running in a line along the vertical axis thereof, wherein a locking detent is located on the top planar surface of the lower disk, the locking detent being a flexible flap which is movable between a relaxed position when in between a selected pair of raised nubs during installation, and a flexed position when riding over a selected tab on the upright T-shaped support member for locking the lower disk and, in turn, the cap at a plurality of selected vertical locations on the upright T-shaped support member after installation is complete.

8. The method of claim 7, wherein the upper and lower disks have mating engagement members located thereon, whereby the disks can be initially assembled with the top planar surfaces of the lower disk being in contact with the bottom planar surface of the upper disk and with both disks located at the end opening of the cap.

9. The method of claim 7, wherein the flexible flap has a generally planar body when viewed in cross section having an outermost edge connected by opposing sidewalls to a base region located in the top planar surface of the lower disk, the flexible flap body forming an angle with respect to the top planar surface which is in the range from about fifty to sixty four degrees.

10. The method of claim 9 wherein the angle is approximately sixty degrees.

11. The method of claim 7, wherein the lower disk is formed of a resilient synthetic material and wherein the locking detent is integrally formed as a part of the top planar surface of the lower disk.

* * * * *